United States Patent [19]

Carley

[11] Patent Number: 4,644,220

[45] Date of Patent: Feb. 17, 1987

[54] FILAMENT-CENTERING MOUNTING FOR FLASHLIGHT BULBS

[75] Inventor: James A. Carley, Rolling Hills, Calif.

[73] Assignee: Carley, Torrance, Calif.

[21] Appl. No.: 678,790

[22] Filed: Dec. 6, 1984

[51] Int. Cl.[4] ..... H01J 5/48; H01J 5/50

[52] U.S. Cl. ..... 313/318; 313/315; 339/144 R; 339/146

[58] Field of Search ..... 313/113, 318; 339/59 R, 339/59 L, 144 R, 144 T, 145 R, 145 D, 145 T, 146

[56] References Cited

U.S. PATENT DOCUMENTS

| | | | |
|---|---|---|---|
| 2,821,649 | 1/1958 | Geiger | 339/144 R |
| 3,262,001 | 7/1966 | Rijckeart | 313/318 |
| 3,631,379 | 12/1971 | Wright | 339/145 R |

*Primary Examiner*—David K. Moore
*Assistant Examiner*—Theodore C. Salindong
*Attorney, Agent, or Firm*—Daniel C. McKown

[57] ABSTRACT

A stiffener is bonded to the bead of the flashlight bulb and extends along and between the pins. The stiffener includes indexing surfaces for use in laterally positioning the stiffener and flashlight bulb. An insert is bonded into a PR base so that the exposed end of the insert is a prescribed axial distance from an axial reference surface of the PR base. The insert includes a first set of indexing surfaces that center the insert in the PR base. The insert also includes a second set of indexing surfaces for receiving and centering the indexing surfaces of the stiffener with respect to the insert. The stiffener is inserted into the insert far enough that the bead of the flashlight bulb contacts the exposed end of the insert, thereby assuring that the filament is a prescribed distance from the axial reference surface of the PR base. A tight sliding fit between the stiffener and the insert assures that the stiffener is centered within the insert, which in turn is centered within the PR base. Through these means the filament of the flashlight bulb is accurately and repeatably located with respect to the PR base.

7 Claims, 11 Drawing Figures

FILAMENT-CENTERING MOUNTING FOR FLASHLIGHT BULBS

BACKGROUND OF THE INVENTION

1. Field of the Invention

The present invention is in the field of electrical apparatus and more specifically relates to an adapter that permits a pin type flashlight bulb to be used in a PR type base.

2. The Prior Art

Two levels of quality may be discerned in flashlights that are produced today. On the one hand there are the relatively inexpensive, low-performance flashlights made for providing illumination in household use, and on the other hand there are high-quality high-performance flashlights that are made for professional use, such as use by police and rescue workers.

In addition to being more rugged, the professional quality flashlight must be capable of forming a highly collimated beam. This is possible only if the filament of the flashlight bulb is precisely centered on the centerline of the base of the bulb and is accurately located at the correct position along the axis of the bulb. Typically, the filament must be located with an accuracy of 0.005 inches (0.127 millimeters).

The manufacturing of high quality flashlight bulbs for use in professional type flashlights is a highly developed art. During the manufacturing process, the bulbs are adjusted individually to insure that the filament is accurately located with respect to the base of the bulb. This adjusting and checking of individual bulbs occupies the larger part of the production time. As will be seen below, the present invention permits the hard-won accuracy to be utilized to the greatest advantage in the production of professional quality flashlights.

One type of flashlight bulb for use in professional grade flashlights is called a pin type bulb because it is mounted by two wires which extend through the bead which forms the base of the bulb. When such a bulb is installed by the consumer, it sometimes happens that the wires become bent from their desired positions, and this can throw the filament off center, thereby preventing proper collimation. It is necessary for the user then to try to straighten the wires and that is a frustrating and time-consuming operation. As will be seen below, the present invention includes means for preventing the pins from accidentally becoming bent.

SUMMARY OF THE INVENTION

In one aspect of the present invention, a stiffener is provided between the pins of the flashlight bulb to keep the pins from becoming bent and thereby to maintain the accuracy of the centering of the filament. In the preferred embodiment, the stiffener is a separate part that is bonded to the base of the flashlight bulb, while in an alternative embodiment, the stiffener is an integral extension of the bead that constitutes the base of the flashlight bulb.

In another aspect of the invention, an insert is provided for use in a PR type base. The insert includes contacts for insuring a good electrical contact with the pins of the flashlight bulb.

In another aspect of the present invention, the stiffener and the insert are shaped so as to fit together when the pin type bulb is inserted into the insert within the PR type base. The stiffener fits within the insert, and the insert serves to insure that the pins and stiffener are truly centered within the PR base so as to locate the filament accurately with respect to the flange of the PR type base.

Because the stiffener fits into the insert which has already been installed in the PR base, little time is consumed in centering the filament of the flashlight bulb with respect to the PR base, thereby overcoming one of the more serious difficulties in the prior art production process. The presence of the stiffener prevents the pins of the flashlight bulb from getting bent, thereby making it easier for the consumer to replace the flashlight bulb.

The novel features which are believed to be characteristic of the invention, both as to organization and method of operation, together with further objects and advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 11:
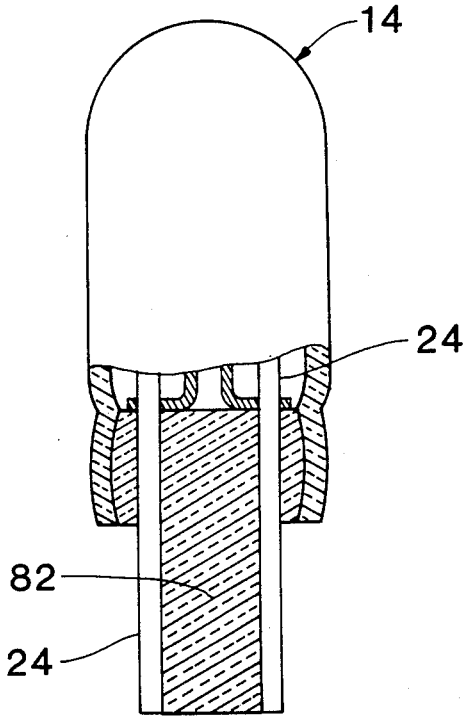
Figure 9:
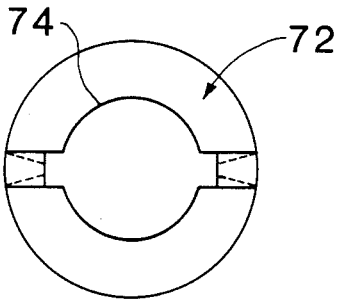
FIG. 9 is a top view of an insert used in an alternative embodiment of the invention.
Figure 10:
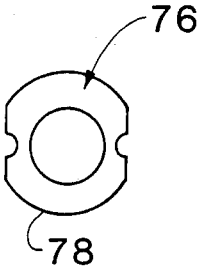
FIG. 10 is a top view of a stiffener used in an alternative embodiment of the invention; and, FIG. 11 is a side view partly in cross section and showing a second alternative embodiment of the invention wherein the stiffener is an integral part of the glass bead of the bulb.

Turning now to the drawings, in which like parts are denoted by the same reference numeral throughout, it is noted that FIGS. 1–8 relate to the preferred embodiment of the invention, while FIGS. 9 and 10 relate to an alternative embodiment and FIG. 11 shows yet another variation of the invention.

Figure 1:
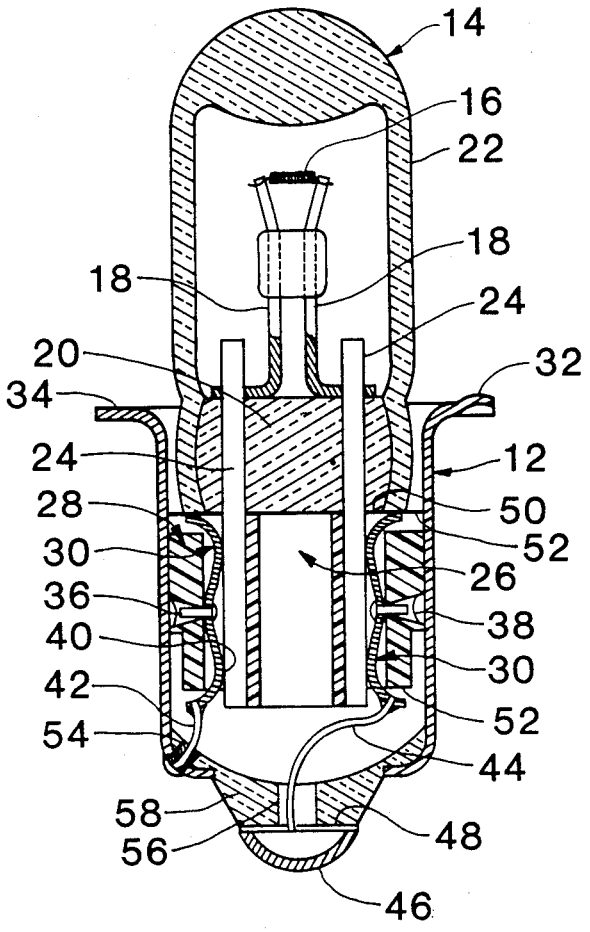
FIG. 1 is a side assembly view partly in cross section and showing the components of a preferred embodiment of the invention installed in a flashlight lamp assembly.

The manner in which the parts are assembled to form the entire mounted flashlight bulb assembly is shown in FIG. 1. The parts and their interrelation will be discussed briefly in connection with FIG. 1, and thereafter, the parts will be discussed in greater detail individually.

The PR type base 12 is a commercially available standard part, well-known in the industry. The present invention includes the parts necessary to permit the flashlight bulb 14 to be mounted in the PR type base 12 with great accuracy in the positioning of the filament 16. The PR type base 12 is spring-loaded against a part of the reflector (not shown). The flange 34 includes three indexing bumps of which the bump 32 is typical, located 120° apart around the flange 34. These indexing bumps 32 serve to locate the PR type base 12 with respect to the reflector with considerable precision. Therefore, if the filament 16 is to be precisely positioned with respect to the reflector, it is necessary that the filament 16 be precisely and repeatably positioned within the PR type base 12.

The flashlight bulb 14 includes the filament 16 which is supported by the filament supports 18. The filament supports 18 are welded to the pins 24 which extend through the bead 20. After the filament supports 18 have been welded to the pins 24, and after the space within the envelope 22 has been evacuated or filled with an inert gas, the lower end of the envelope 22 is fused to the bead 20 to seal the bulb.

In the preferred embodiment of the present invention, the filament is centered laterally with respect to the pins before the bulb is sealed, and therefore the problem of centering the filament with respect to the reflector resolves itself into positioning the flashlight bulb 14 accurately within the PR type base. As will be seen below, in the present invention this is accomplished by use of a stiffener 26 and an insert 28 that cooperate to center the flashlight bulb with respect to the PR type base 12. The contacts 30 are affixed to the insert 28 by use of the rivets 36 that may be deformed in the usual manner, or that may be held in place by a deposit of high temperature epoxy 38.

In the preferred embodiment, the pins 24 include small recesses 40 into which the contacts 30 slide to give a detenting action. The contacts 30 are connected to the terminals of the PR type base by the leads 42, 44, with are purposely left longer than necessary, so as to permit flexing as the contacts 30 are bent during insertion of the pins.

A brass shell 46 is soldered to the center terminal plate 48, and the exposed surface of the brass shell is gold plated to promote better electrical contact.

The steps in forming the assembly shown in FIG. 1 are as follows: The lead wires 42, 44 are attached to the contacts 30 and the contacts 30 are then attached to the insert 28 by means of the rivets 36 as mentioned above. Thereafter, the insert 28 is pushed into the PR type base 12 until the top surface of the insert 28 is the desired distance from the plane defined by the three indexing bumps 32. As the insert is pushed into the PR type base, the leads 42, 44 are drawn out through the holes 54, 56, respectively in the end 58 of the PR type base. A convenient way of insuring that the insert 28 is pushed the correct distance into the PR type base is to push the PR type base towards a plane surface from which a plug extends the desired distance above the plane surface. When the insert has thus been positioned at the desired location within the PR base, it is secured in that position by a high temperature epoxy.

Separately from the subassembly consisting of the PR type base and the insert, a second subassembly consisting of the flashlight bulb 14 and the stiffener 26 is assembled. The stiffener 26 is slid between the pins 24, until the stiffener is in contact with the bottom surface 50 of the bead 20. In the preferred embodiment, the stiffener is bonded to the bead by a high temperature epoxy.

The final step in producing the assembly shown in FIG. 1 is to insert the flashlight bulb 14 with the stiffener 26 secured between the pins 24, into the insert 28 that is part of the first subassembly described above. The flashlight bulb 14 is pushed into the PR type base 12 until the bottom surface 50 of the bead 20 makes contact with the top surface 52 of the insert 28.

Figure 2:
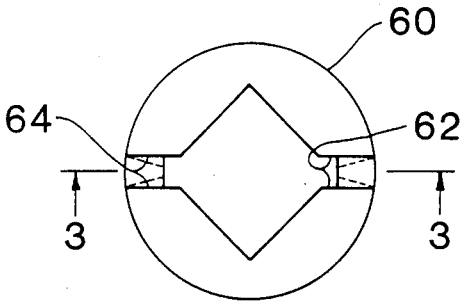
FIG. 2 is a top view of an insert used in a preferred embodiment of the invention.
Figure 3:
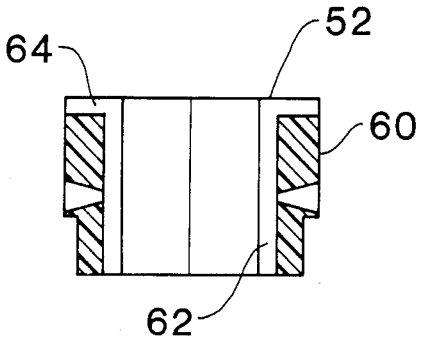
FIG. 3 is a side cross sectional view of the insert of FIG. 2 in the direction 3—3 indicated in FIG. 2.

FIGS. 2 and 3 are respectively a top view and a side cross-sectional view of the insert 28. The insert has a cylindrical outer surface 60 that is approximately equal in diameter to the bore of the PR type base 12, so that the insert can be slid into the PR type base with a tight sliding fit. The central passage of the insert is square in cross-section to accommodate the stiffener shown in FIGS. 4 and 5. The stiffener is sized to fit into the central passage of the insert with a tight sliding fit, so as to prevent any play, and thereby maintaining the dimensional tolerances so necessary to the production of a truly precision-type flashlight. The insert also includes a groove 62 that extends in the axial direction and into which the contacts are mounted. Another groove 64 extends radially across the top surface 52 of the insert to provide clearance for the end of the contact as indicated in FIG. 1.

In the preferred embodiment, the insert 28 also includes conical holes into which the rivets 36 extend and are secured.

In a preferred embodiment, the insert is molded of a high temperature plastic.

Figure 4:
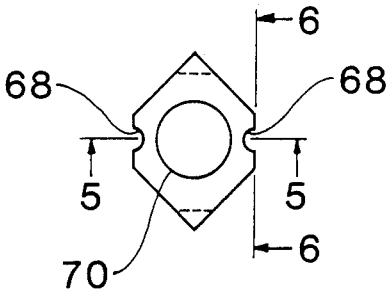
FIG. 4 is a top view of a stiffener used in a preferred embodiment of the invention.
Figure 5:
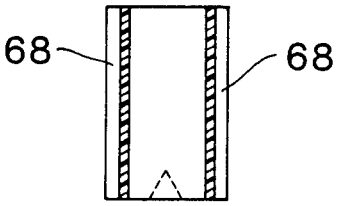
FIG. 5 is a side cross sectional view of the stiffener of FIG. 4 in the direction 5—5 indicated in FIG. 4.
Figure 6:
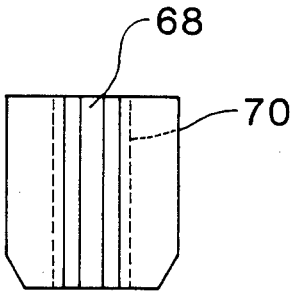
FIG. 6 is a side cross sectional view of the stiffener of FIG. 4 in the direction 6—6 indicated in FIG. 4.

FIGS. 4, 5 and 6 show the stiffener 26 in a preferred embodiment. The top view of FIG. 4 shows the stiffener as sized and shaped to fit into the square center portion of the insert as shown in FIG. 2. The grooves 68 in the stiffener are spaced and shaped to accommodate the pins 24. The stiffener serves two important functions. First, it prevents the pins 24 from becoming bent, and second, it centers the flashlight bulb 14 within the insert 28 which is centered within the PR type base 12. The stiffener includes a central passage of circular cross-section 70.

FIGS. 9 and 10 show respectively an insert 72 and a stiffener 76 used in an alternative embodiment. This embodiment differs from the preferred embodiment only in the following respects. The central passage 74 of the insert 72 of FIG. 9 is circular in cross-section rather than square as in FIG. 2. Also, the stiffener 76 of FIG. 10 has an outer surface 78 that is sized and shaped to fit with a tight sliding fit within the central passage 72 of the insert of FIG. 9.

As was the case in connection with the insert of FIG. 3 and the stiffener of FIG. 5, the stiffener 76 of FIG. 10 serves to center the flashlight bulb 14 in the insert 72, and the insert 72 centers the flashlight bulb and stiffener subassembly in the PR type base 12.

The filament of a high performance flashlight bulb produces a considerable amount of heat, and an appreciable portion of the heat is conducted through the filament supports 18 and the pins 24 into the stiffener and insert. Accordingly, the stiffener and the insert are made of high temperature plastic or ceramic.

Figure 7:
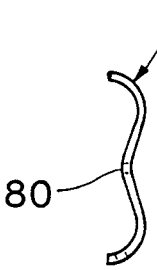
FIG. 7 is a side view of contact used in a preferred embodiment of the invention.
Figure 8:
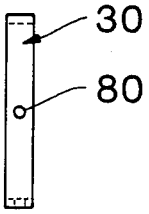
FIG. 8 is a front view of the contact of FIG. 7.

FIGS. 7 and 8 show respectively a side and front view of one of the contacts 30. The contacts are made of a resilient metal such as beryllium copper and are gold-plated in the preferred embodiment. The contact includes a hole 80 for the rivet 36 and is shaped to permit a non-binding insertion and removal of the flashlight bulb.

FIG. 11 shows a second alternative embodiment in which the stiffener 82 is an integral part of the bead 20 of the flashlight bulb.

Although the term "flashlight bulb" has been used for simplicity in the above description, those skilled in the art will recognize that the mounting arrangement of the present invention is not limited to use in flashlights, or even with incandescent lamps.

Thus, there has been described several embodiments of a mounting for a flashlight bulb, and it is recognized that variations on the embodiments shown are not precluded. Such variations as would be apparent to workers in the art are considered to be within the scope of the invention which is defined more specifically by the claims that follow.

What is claimed is:

1. Apparatus for accurately indexing and mounting a flashlight bulb in a generally cylindrical cup-shaped base having a closed end and an open end and having a flange extending radially outwardly from the open end, said flange including an axial indexing surface, said apparatus comprising in combination:

a bead;

a filament accurately located with respect to said bead;

at least one pin that extends from said bead on the opposite side of said bead from said filament;

stiffener means connected to said bead and extending from said bead substantially the entire length of said at least one pin to prevent the pin from being bent in normal use, and including a radial indexing surface;

insert means composed of a rigid material and including an axial indexing surface, affixed within the base with its axial indexing surface a prescribed distance from the axial indexing surface of the base, and including a first radial indexing surface for contacting the inside of said cup-shaped base to center said insert within the base, and including a second radial indexing surface for receiving and contacting the radial indexing surface of said stiffener means to center said stiffener means within said insert means, whereby when said stiffener means are coupled to said insert means with the bead of the flashlight bulb abutting the axial indexing surface of said insert means, said filament will be accurately indexed and mounted in both the radial and axial directions with respect to the base.

2. The apparatus of claim 1 wherein said insert means are bonded to said base.

3. The apparatus of claim 1 wherein said stiffener means are bonded to the bead of the flashlight bulb.

4. The apparatus of claim 1 wherein said stiffener means are an integral part of the bead of the flashlight bulb.

5. The apparatus of claim 1 wherein the second radial indexing surface of said insert means defines a passage through said insert means for receiving said stiffener.

6. The apparatus of claim 5 wherein said passage has a square cross section.

7. The apparatus of claim 5 wherein said passage has a circular cross section.

* * * * *